US009067450B2

(12) United States Patent
Waumans et al.

(10) Patent No.: US 9,067,450 B2
(45) Date of Patent: Jun. 30, 2015

(54) COLOUR LASER MARKING METHODS OF SECURITY DOCUMENT PRECURSORS

(75) Inventors: Bart Waumans, Puurs (BE); Paul Callant, Edegem (BE); Ingrid Geuens, Emblem (BE)

(73) Assignee: Agfa-Gevaert N.V., Mortsel (BE)

( * ) Notice: Subject to any disclaimer, the term of this patent is extended or adjusted under 35 U.S.C. 154(b) by 5 days.

(21) Appl. No.: 14/241,115

(22) PCT Filed: Sep. 4, 2012

(86) PCT No.: PCT/EP2012/067216

§ 371 (c)(1), (2), (4) Date: Feb. 26, 2014

(87) PCT Pub. No.: WO2013/037672

PCT Pub. Date: Mar. 21, 2013

(65) Prior Publication Data

US 2014/0232810 A1 Aug. 21, 2014

Related U.S. Application Data

(60) Provisional application No. 61/533,804, filed on Sep. 13, 2011.

(30) Foreign Application Priority Data

Sep. 12, 2011 (EP) ..... 11180888

(51) Int. Cl.
*B41J 2/435* (2006.01)
*G03C 8/00* (2006.01)
(Continued)

(52) U.S. Cl.
CPC ..... *B41M 3/14* (2013.01); *B41M 3/142* (2013.01); *B41M 5/267* (2013.01); *B41M 5/323* (2013.01); *B41M 5/34* (2013.01)

(58) Field of Classification Search
CPC ..... B41M 5/34; B41M 5/267; B41M 3/142; B41M 5/42; B41M 5/44; B41M 5/323; B41M 5/327; B41M 5/3372; B41M 5/3336; B41M 2205/38; B41M 2205/04
USPC ..... 347/224, 225; 430/945; 503/204
See application file for complete search history.

(56) References Cited

U.S. PATENT DOCUMENTS 3,649,336 A 3/1972 Van Paesschen et al.
4,663,518 A 5/1987 Borror et al.
(Continued)

FOREIGN PATENT DOCUMENTS

EP 0174054 A2 3/1985
EP 0605149 A2 7/1994
(Continued)

OTHER PUBLICATIONS

International Search Report in corresponding International Patent Application No. PCT/EP2012/067216, mailed Oct. 8, 2012.

*Primary Examiner* — Hai C Pham
(74) *Attorney, Agent, or Firm* — Leydig, Voit & Mayer, Ltd.

(57) ABSTRACT

A method of color laser marking a security document precursor including at least: a transparent biaxially stretched polyethylene terephthalate foil; at least one colorless color forming layer for generating a color different from black containing at least an infrared absorber a color forming compound and a polymeric binder; and a laser markable polymeric support or a laser markable layer for generating a black color; comprising the steps of:

laser marking the colorless color forming layer through the transparent polymeric foil with a infrared laser used in continuous wave mode to generate a color different from black; and laser marking the laser markable polymeric support or the laser markable layer through the transparent polymeric foil with the same infrared laser but used in a pulsed mode to generate a black color.

15 Claims, 1 Drawing Sheet

(51) Int. Cl.

| | |
|---|---|
| ***B41M 3/14*** | (2006.01) |
| ***B41M 5/26*** | (2006.01) |
| ***B41M 5/323*** | (2006.01) |
| ***B41M 5/34*** | (2006.01) |

(56) References Cited

U.S. PATENT DOCUMENTS

| | | | | |
|---|---|---|---|---|
| 4,720,449 | A | 1/1988 | Borror et al. | |
| 4,742,042 | A | 5/1988 | Hiraishi et al. | |
| 5,200,947 | A | 4/1993 | Satake et al. | |
| 5,243,052 | A | 9/1993 | Taylor et al. | |
| 5,410,335 | A | 4/1995 | Sawano et al. | |
| 6,017,972 | A * | 1/2000 | Harris et al. | 522/2 |
| 6,100,009 | A | 8/2000 | Obayashi et al. | |
| 7,097,899 | B2 | 8/2006 | Daems et al. | |
| 7,158,145 | B1 | 1/2007 | Fannasch et al. | |
| 7,980,596 | B2 * | 7/2011 | Labrec | 283/75 |
| 8,411,120 | B2 * | 4/2013 | Wu et al. | 347/172 |
| 8,786,651 | B2 | 7/2014 | Geuens et al. | |
| 8,912,118 | B2 | 12/2014 | Callant et al. | |
| 2001/0044553 | A1 | 11/2001 | Kabashima et al. | |
| 2003/0183695 | A1 | 10/2003 | Labrec et al. | |
| 2005/0001419 | A1 | 1/2005 | Levy et al. | |
| 2006/0276335 | A1 | 12/2006 | Tsuboi et al. | |
| 2008/0076065 | A1 | 3/2008 | Bennett et al. | |
| 2008/0224462 | A1 | 9/2008 | Dubner et al. | |
| 2008/0238086 | A1 | 10/2008 | Geuens et al. | |
| 2010/0099556 | A1 | 4/2010 | Vetterling et al. | |
| 2013/0229008 | A1 | 9/2013 | Van Aert et al. | |
| 2013/0233932 | A1 | 9/2013 | Waumans et al. | |

FOREIGN PATENT DOCUMENTS

| | | | | |
|---|---|---|---|---|
| EP | 0 739 748 | A1 | 10/1996 | |
| EP | 1452334 | A2 | 9/2004 | |
| EP | 1800885 | A1 | 6/2007 | |
| EP | 2 181 858 | A1 | 5/2010 | |
| EP | 2181858 | A1 * | 5/2010 | B42D 15/10 |
| EP | 2199100 | A1 | 6/2010 | |
| EP | 2463109 | A1 | 6/2012 | |
| GB | 811066 | | 3/1959 | |
| GB | 1441591 | | 7/1976 | |
| JP | 61-175077 | | 8/1986 | |
| WO | WO 2005/025885 | A1 | 3/2005 | |
| WO | WO 2006/042714 | A1 | 4/2006 | |
| WO | WO 2009/140083 | A2 | 11/2009 | |
| WO | WO 2012/076354 | A2 | 6/2012 | |
| WO | WO 2012/076406 | A1 | 6/2012 | |
| WO | WO 2012/076488 | A1 | 6/2012 | |

* cited by examiner

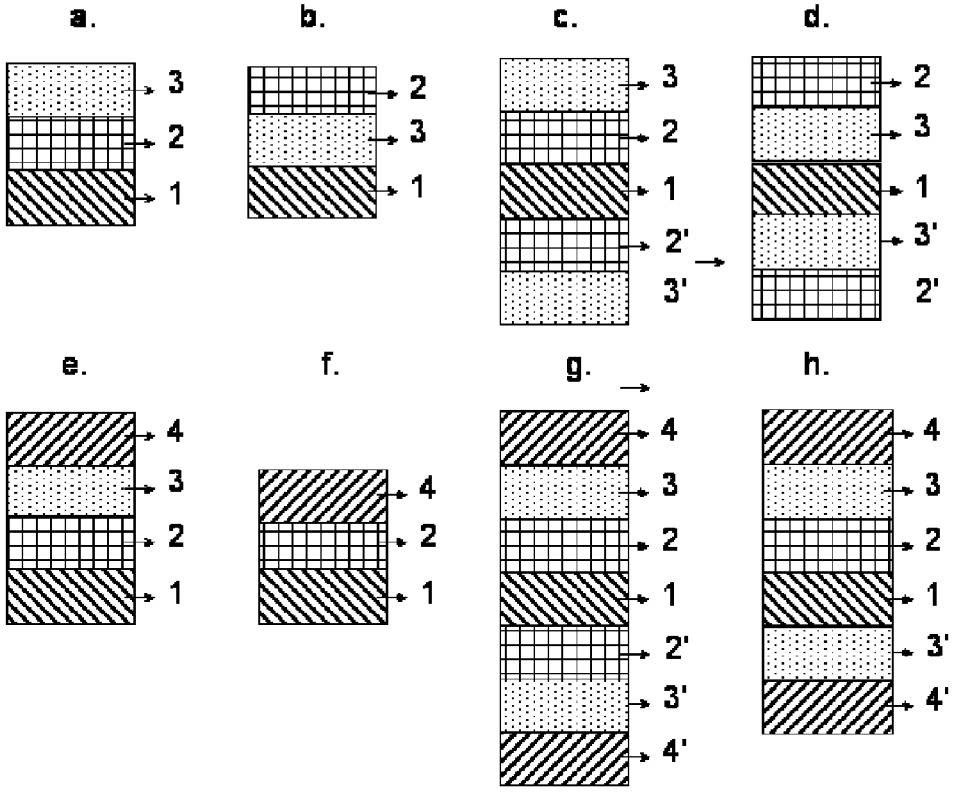
a.
3
2
1
b.
2
3
1
c.
3
2
1
2'
3'
d.
2
3
1
3'
2'
e.
4
3
2
1
f.
4
2
1
g.
4
3
2
1
2'
3'
4'
h.
4
3
2
1
3'
4'

COLOUR LASER MARKING METHODS OF SECURITY DOCUMENT PRECURSORS

CROSS-RFERENCE TO RELATED APPLICATIONS

This patent application is U.S. National Phase Application of copending International Patent Application No. PCT/EP2012/067216, filed Sep. 4, 2012, which claims the benefit of U.S. Provisional Patent Application No. 61/533,804, filed Sep. 13, 2011 and European Patent Application No. 11180888.7, filed Sep. 12, 2011, all of which are hereby incorporated by reference in their entireties.

TECHNICAL FIELD

This invention relates to methods for colour laser marking security documents and security document precursors suitable therefore.

BACKGROUND ART

Security cards are widely used for various applications such as identification purposes (ID cards) and financial transfers (credit cards). Such cards typically consist of a laminated structure consisting of various paper or plastic laminates and layers wherein some of them may carry alphanumeric data and a picture of the card holder. So called 'smart cards' can also store digital information by including an electronic chip in the card body.

A principal objective of such security cards is that they cannot be easily modified or reproduced in such a way that the modification or reproduction is difficult to distinguish from the original.

Two techniques frequently used for preparing security documents are laser marking and laser engraving. In literature, laser engraving is often incorrectly used for laser marking. In laser marking, a colour change is observed by local heating of material, while in laser engraving material is removed by laser ablation.

US 2005001419 (DIGIMARK) discloses a colour laser engraving method and a security document including an opaque surface layer and one or more coloured sub-layers. A laser provides openings in the surface layer to expose the colour of the sub-layer thereby creating colour images and text.

WO 2009/140083 (3M) discloses methods to generate a colour image in a multilayer article containing at least one thermally activatable layer coated from a composition including a non-linear light to heat converter, a leuco dye, a thermal acid generator and a solvent. A colour image is formed in the colour forming layer upon activation with non-linear light beam radiation (300-1500 nm).

U.S. Pat. No. 7,158,145 (ORGA SYSTEMS) discloses a three-wavelength system (440, 532 and 660 nm) for applying coloured information to a document by means of wavelength-selective bleaching of chromophoric particles in a layer close to the surface.

U.S. Pat. No. 4,720,449 (POLAROID) discloses a thermal imaging method for producing colour images on a support carrying at least one layer of a colourless compound, such as di- or triarylmethane, by direct application of heat or by conversion of electromagnetic radiation into heat. The laser beam may have different wavelengths, typically in a range above 700 nm with at least about 60 nm apart so that each imaging layer may be exposed separately to convert a colourless triarylmethane compound into a coloured form, such as yellow, magenta, cyan or black, by controlling the focusing depth of the laser beam source to each colour forming layer. The colour forming compositions include di- or triarylmethane compounds, infrared absorbers, acidic substances and binders.

U.S. Pat. No. 4,663,518 (POLAROID) discloses a laser printing method for activating heat sensitive image forming dyes in three different layers on a support to provide an identification card containing a coloured pictorial image of the card holder, coloured text and machine readable digital code.

In conventional printing techniques, such as offset and inkjet printing, four colours (CMYK) are normally used to obtain optimal image quality and colour gamut. The colour laser marking systems described for producing security documents generally use three colours: cyan, magenta and yellow (CMV). The black colour (K) produced by colour addition of the three other colours (CMY) tends to be a brownish black colour rather than the desired neutral black colour. Adding a fourth layer to produce a neutral black colour makes the apparatus for producing the security card more complex and expensive since this requires an extra laser.

Therefore, it would be desirable to have a secure colour laser marking system for producing security documents with improved image quality (neutral black colour) without increasing the complexity of the laser marking apparatus or the recording material.

SUMMARY OF INVENTION

In order to overcome the problems described above, preferred embodiments of the present invention provide a simple and cost-effective method of colour laser marking security document precursors as defined herein.

It is a further object of the present invention to provide security documents having an improved image quality and which are much more difficult to falsify.

In the unpublished European Patent application EP10193893.4, it was found that by using an infrared laser in two different output modes, i.e. pulsed mode and continuous wave mode, two different halftone images could be made in a black colour, respectively in a colour different from black, e.g. a cyan or a magenta colour.

Q-switching is a technique by which a laser can be made to produce a pulsed output beam. The technique allows the production of light pulses with extremely high peak power, much higher than would be produced by the same laser if it were operating in a continuous wave (constant output) mode, Q-switching leads to much lower pulse repetition rates, much higher pulse energies, and much longer pulse durations.

However, using an infrared laser in the two different output modes of pulsed mode and continuous wave mode tends to slow down the recording process of a security document, because the sequential switching between these modes causes a time delay. When using the same laser mode, i.e. pulsed mode, the pulse repetition rate can be changed on the fly so that simultaneous laser marking of black markings and markings in a colour different from black is possible.

It was surprisingly found that using an infrared laser in the same pulsed mode for producing the black colour halftone images, but at much higher pulse repetition rate made it possible to produce halftone images in a colour different from black, e.g. a cyan or a magenta colour. A pulse repetition rate of 15 kHz or more is not so often used in laser marking because it represents a less efficient energy transfer from the laser to the material.

In laser marking the switching in pulse repetition rate of the pulsed laser mode is faster and technically much easier than switching between a pulsed mode and continuous wave laser mode.

Another advantage is that a four coloured image, for example a CMYK-coloured image, can be laser marked in a security document precursor by using only three different infrared lasers at three different wavelengths instead of four different infrared lasers at four different wavelengths. This not only reduces the cost of the laser apparatus and the security document precursor, but also drastically simplifies their construction.

Further advantages and embodiments of the present invention will become apparent from the following description.

DESCRIPTION

BRIEF DESCRIPTION OF DRAWINGS

FIG. 1 shows suitable security document precursors for use in the laser marking method according to the present invention.

FIG. 1.*a* shows a cross-section of an asymmetrical security document precursor having a support (1), a colourless colour forming layer for generating a colour different from black (2) and a laser markable layer for generating a black colour (3).

FIG. 1.*b* shows a cross-section of an asymmetrical security document precursor similar to the one of FIG. 1.*a* wherein the order of the colourless colour forming layer for generating a colour different from black (2) and the laser markable layer for generating a black colour (3) has been altered.

FIG. 1.*c* and FIG. 1.*d* show cross-sections of symmetrical security document precursor having colourless colour forming layers for generating a colour different from black (2) and (2') and laser markable layers for generating a black colour (3) and (3') on both sides of the support (1).

FIG. 1.*e* shows the asymmetrical security document precursor of FIG. 1.*a* having an additional layer or polymeric foil (4) on top of the laser markable layer for generating a black colour.

FIG. 1.*f* shows a cross-section of an asymmetrical security document similar to that of FIG. 1.*a* except that the support (1) itself is a laser markable polymeric support for generating a black colour.

FIG. 1.*g* shows the symmetrical security document precursor of FIG. 1.*c* having additional layers or polymeric foils (4) and (4') on top of the laser markable layers (3) and (3') for generating a black colour.

FIG. 1.*h* shows an asymmetrical security document precursor having a support (1), a colourless colour forming layers for generating a colour different from black (2) and two laser markable layers for generating a black colour (3) and (3') and additional layers or polymeric foils (4) and (4').

DEFINITIONS

The term "graphical data" as used in disclosing the present invention means any graphical representation, e.g. a picture of a person, a drawing, etc.

The term "information" as used in disclosing the present invention means any alphanumeric data, e.g. name, place of birth, date of birth, etc.

The term "image" as used in disclosing the present invention means any graphical data and information. The image on a security document preferably varies at least partially from one security document to another one.

The term "security document" as used in disclosing the present invention means a document which contains the required image, e.g. a valid passport or identification card, and is ready for use.

The term "security document precursor" as used in disclosing the present invention means a document not containing all the required components of the security document, e.g. a layer or a security feature, and/or not containing the required image of the security document.

The term "visible spectrum" as used in disclosing the present invention means the electromagnetic spectrum from 400 nm to 700 nm.

The term "polymeric foil" as used in disclosing the present invention, means a self-supporting polymer-based sheet, which may be associated with one or more adhesion layers e.g. subbing layers. Foils are generally manufactured through extrusion.

The term "support" as used in disclosing the present invention, means a self-supporting polymer-based sheet, which may be transparent but is preferably opaque and which may be associated with one or more adhesion layers e.g. subbing layers. Supports are generally manufactured through extrusion.

The term "layer", as used in disclosing the present invention, is considered not to be self-supporting and is manufactured by coating it on a support or a polymeric foil.

"PET" is an abbreviation for polyethylene terephthalate.

"PETG" is an abbreviation for polyethylene terephthalate glycol, the glycol indicating glycol modifiers which are incorporated to minimize brittleness and premature aging that occur if unmodified amorphous polyethylene terephthalate (APET) is used in the production of cards.

"PET-C" is an abbreviation for crystalline PET, i.e. a biaxially stretched polyethylene terephthalate. Such a polyethylene terephthalate support or foil has excellent properties of dimensional stability.

The definitions of security features correspond with the normal definition as adhered to in the "Glossary of Security Documents—Security features and other related technical terms" as published by the Consilium of the Council of the European Union on Aug. 25, 2008 (Version: v.10329.02.b.en) on its website: http://www.consilium.europa.eu/prado/EN/glossaryPopup.html.

The term "alkyl" means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methylbutyl etc.

The term "substituted" in, for example substituted alkyl, means that the substituent on alkyl contains at least one atom different from carbon or hydrogen. The substituent may be a single atom (e.g. a halogen) or a group of atoms containing at least one atom different from carbon or hydrogen (e.g. an acrylate group).

The term "chlorinated ethylene", as used in disclosing the present invention, means ethylene substituted with at least one chlorine atom e.g. vinyl chloride, vinylidene chloride, 1,2-dichloro-ethylene, trichloroethylene and tetrachloroethylene. Trichloroethylene and tetrachloroethylene are all much more difficult to polymerize than vinyl chloride or vinylidene chloride.

A leuco dye is a well-known colour forming compound whose molecules can acquire two forms, one of which is colourless. An example of a leuco dye is crystal violet lactone, which in its lactone form is colourless, but when it is protonated becomes intensely violet.

Methods of Colour Laser Marking

In the present invention, the method of colour laser marking a security document precursor including at least:

a polymeric foil;

at least one colourless colour forming layer for generating a colour different from black containing at least an infrared absorber, a colour forming compound and a polymeric binder; and a laser markable polymeric support or a laser markable layer for generating a black colour;

comprises the steps of:

laser marking the colourless colour forming layer with an infrared laser used in pulsed mode at a pulse repetition rate of at least 15 kHz to generate a colour different from black; and laser marking the laser markable polymeric support or the laser markable layer with the same infrared laser used in a pulsed mode at a pulse repetition rate of at most 5 kHz to generate a black colour.

The colourless colour forming layer includes an infrared absorber which is capable of converting the infrared light of the infrared laser into heat which triggers the colour formation reaction. Hence, the laser emission wavelength of the infrared laser preferably matches the absorption maximum of the infrared dye within 40 nm, more preferably within 25 nm.

Preferably, the infrared laser used in the method of colour laser marking an article according to the present invention is an optically pumped semiconductor laser or a solid state Q-switched laser. Such lasers are widely commercially available.

In the present invention, the pulsed output is used at pulse repetition rates of at least 15 kHz, preferably at least 20 kHz, and more preferably at least 25 kHz for laser marking the at least one colourless colour forming layer for generating a colour different from black. For avoiding blister formation or low maximum optical densities, i.e. less than 0.7, the pulsed output is used at pulse repetition rates of less than 50 kHz, preferably less than 40 kHz, and more preferably less than 30 kHz for laser marking the at least one colourless colour forming layer for generating a colour different from black.

In the present invention, the pulsed output is used at pulse repetition rates of at most 5 kHz, preferably at most 3 kHz, and more preferably at most 1 kHz for laser marking the laser markable polymeric support or the laser markable layer for generating a black colour.

A halftone image, i.e. an image including different optical densities, is obtained by modulating the light pulse's of the laser. For laser marking different optical densities of grey to black on a security document precursor the modulation can be executed e.g. by controlling the pulse repetition rate below 5 kHz, by controlling the light intensity of a pulse or combinations thereof. For laser marking different optical densities of a colour different from black, e.g. cyan, magenta, yellow, red, green or blue, on a security document precursor the modulation can be executed in a similar manner as for the black colour except that the pulse repetition rate is at least 15 kHz. For obtaining no optical density, i.e. minimum optical density $D_{min}$, the laser beam is preferably deflected.

Security Documents and Precursors

The security document precursor includes preferably at least:

a polymeric foil;

at least one colourless colour forming layer for generating a colour different from black containing at least an infrared absorber, a colour forming compound and a polymeric binder; and a laser markable polymeric support or a laser markable layer for generating a black colour;

wherein the polymeric support is selected from the group selected from polycarbonate, polyvinyl chloride, polystyrene, polystyrene-acrylonitrile-butadiene and copolymers thereof;

and wherein the laser markable layer includes:

i) a laser additive; and ii) a polymer selected from the group consisting of polystyrene, polycarbonate and polystyrene acrylonitrile.

The security document precursor contains at least one colourless colour forming layer, but preferably contains two, three or more colourless colour forming layers for producing a multi-coloured security document. Most preferably the security document includes, three colourless colour forming layers containing different infrared absorbers and colour forming compounds.

In one preferred embodiment, the three colourless colour forming layers containing different infrared absorbers and colour forming compounds are turned into three at least partially coloured layers having preferably a cyan, a magenta or a yellow colour.

In another preferred embodiment, the three colourless colour forming layers containing different infrared absorbers and colour forming compounds are turned into three at least partially coloured layers having preferably a red, a green or a blue colour.

Having either CMY- or RGB-coloured layers has the advantage that a well-established colour management system can be used for producing colour images based on either a CMY or RGB colour reproduction.

The infrared absorber not only delivers the heat for the colour forming action, but also has the advantage that there is no or minimal absorption in the visible spectrum and thus there is no or minimal interference with the colours formed by the one or more colourless colour forming layers. This allows a security document to have a pure white background.

The security document precursor can be symmetrical or an asymmetrical. In a symmetrical document precursor the same layers are present on both sides of the support (1) as shown in e.g. FIGS. 1.*c*, 1.*d* and 1.*g*. This has the advantage that possible curl of the security document (precursor) after lamination is minimized contrary to the asymmetrical document precursors shown in FIGS. 1.*a* and 1.*b*. Therefore, the security document precursor is preferably symmetrical.

In a preferred embodiment, the security document obtained from laser marking the security document precursor is selected from the group consisting of a passport, a personal identification card and a product identification document.

The security document preferably also contains electronic circuitry, more preferably the electronic circuitry includes a RFID chip with an antenna and/or a contact chip. The security document is preferably a "smart card", meaning an identification card incorporating an integrated circuit. In a preferred embodiment the smart card includes a radio frequency identification or RFID-chip with an antenna.

The security document preferably has a format as specified by ISO 7810. ISO 7810 specifies three formats for identity cards: ID-1 with the dimensions 85.60 mm×53.98 mm, a thickness of 0.76 mm is specified in ISO 7813, as used for bank cards, credit cards, driving licences and smart cards; ID-2 with the dimensions 105 mm×74 mm, as used in German identity cards, with typically a thickness of 0.76 mm; and ID-3 with the dimensions 125 mm×88 mm, as used for passports and visa's. When the security cards include one or more contactless integrated circuits then a larger thickness is tolerated, e.g. 3 mm according to ISO 14443-1.

In another preferred embodiment, the security document is a product identification document which is attached to the packaging material of the product or to the product itself. The product identification document according to the present invention not only allows to verify the authenticity of the product, but to maintain the attractive look of a product (packaging) due to the enhanced image quality by making neutral black laser markings in colour images possible.

Colourless Colour Forming Layers

The security document precursor used in the laser marking method according to the present invention contains at least one colourless colour forming layer for generating a colour different from black including at least:

a) an infrared absorber;

b) a colour forming compound; and c) a polymeric binder.

The at least one colourless colour forming layer can be coated onto the polymeric foil by any conventional coating technique, such as dip coating, knife coating, extrusion coating, spin coating, slide hopper coating and curtain coating. Preferably the colourless colour forming layer is coated with a slide hopper coater or a curtain coater, more preferably coated onto the polymeric foil including a subbing layer.

The dry thickness of the colourless colour forming layer is preferably between 5 and 40 g/m$^2$, more preferably between 7 and 25 g/m$^2$, and most preferably between 10 and 15 g/m$^2$.

The security document precursor used in the laser marking method according to present invention contains at least one colourless colour forming layer containing an infrared absorber, a polymeric binder and a colour forming compound, but preferably contains two, three or more colourless colour forming layers for producing a multi-coloured security document.

The security document precursor used in the laser marking method according to present invention is preferably a multi-coloured article containing at least three colourless colour forming layers containing different infrared absorbers and colour forming compounds The infrared absorber not only delivers the heat for the colour forming action, but also has the advantage that there is no or minimal absorption in the visible spectrum and thus there is no or minimal interference with the colours formed by the one or more colourless colour forming layers.

The infrared absorber not only delivers the heat for the colour forming action, but also has the advantage that there is no or minimal absorption in the visible spectrum and thus there is no or minimal interference with the colours formed by the one or more colourless colour forming layers. This also allows having, for example, a pure white background in a security document.

Colour Forming Compounds

Colour forming compounds are colourless or slightly yellowish compounds which react into a coloured form.

The colour forming compound is preferably present in the colourless colour forming layer in an amount of 0.5 to 5.0 g/m$^2$, more preferably in an amount of 1.0 to 3.0 g/m$^2$.

For performing the method of colour laser marking according to the present invention, the following reaction mechanisms and the colour forming compounds involved are suitable to form a coloured dye.

1. Fragmentation of a Colourless Dye-Precursor

The reaction mechanism can be represented by:

Colourless dye-FG→Dye wherein FG represents a fragmenting group.

Such a reaction mechanism is explained in more detail by U.S. Pat. No. 5,243,052 (POLAROID) disclosing the colour formation by fragmentation of a mixed carbonate ester of a quinophthalone dye and a tertiary alkanol containing not more than about 9 carbon atoms.

The fragmentation of a colourless dye-precursor may be catalyzed or amplified by acid generating agents. The dyes G-(18) to G-(36) disclosed by U.S. Pat. No. 6,100,009 (FUJI) are catalyzed or amplified by polymeric acid generating agents based on A-(1) to A-(52), which are also suitable as acid generating agents in the present invention.

Another preferred colourless dye-precursor is the leuco dye-precursor (CASRN104434-37-9) shown in EP 174054 A (POLAROID) which discloses a thermal imaging method for forming colour images by the irreversible unimolecular fragmentation of one or more thermally unstable carbamate moieties of an organic compound to give a visually discernible colour shift from colourless to coloured.

The fragmentation of a leuco dye-precursor may be a' two-step reaction mechanism represented by:

Leuco-dye-FG→[Leuco-dye]→Coloured Dye wherein FG represents a fragmenting group.

The fragmentation of a colourless leuco dye-precursor may be catalyzed or amplified by acids and acid generating agents. The leuco dye-precursors G-(1) to G-(17) disclosed by U.S. Pat. No. 6,100,009 (FUJI) are catalyzed or amplified by polymeric acid generating agents based on A-(1) to A-(52), which are also suitable as acid generating agents in the present invention.

2. Protonation of a Leuco Dye after Fragmentation of a H-Donor-Precursor

The reaction mechanism can be represented by:

Leuco-dye+H-donor-RG→Leuco-dye+H-donor→Coloured Dye wherein RG represents a rearranging group.

A preferred H-donor-RG compound is capable of forming a compound having an allyl substituted phenol group as part of its chemical structure (the rest of the compound is represented by the group T) by laser heating:

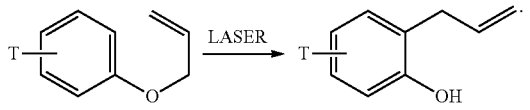

Preferred H-donor-RG compounds include 4-hydroxy-4'-allyloxy diphenylsulfone and 4,4'-diallyloxy diphenylsulfone whereof the synthesis is disclosed by EP 1452334 A (RICOH).

In contrast to the H-donor-FG compound of reaction mechanism 2, no compound having a melting temperature lower than room temperature (20° C.) is produced by the rearrangement of the H-donor-precursor to a hydrogen donor. Consequently, the security feature of blister formation as possible with the H-donor-FG compound cannot be produced by the H-donor-RG compounds.

The colour formation according to the mechanisms 2 and 3 above are two-component reactions involving a leuco dye and a hydrogen donor-precursor, i.e. a 'H-donor-FG compound' or 'H-donor-RG compound', while the first reaction mechanism are one-component reactions. The advantage of using a two-component reaction for the colour formation is that the stability, especially the shelf-life stability, can be enhanced. The probability of undesired colour formation due to environment heating is decreased by going from a single step reaction to a two step reaction involving the formation of the H-donor followed by a reaction of the formed I-1-donor with the leuco dye.

The preferred colour formation mechanism is the protonation of a leuco dye after fragmentation of the H-donor since it includes both advantages of the blister formation security feature and the enhanced shelf-life stability.

In a preferred embodiment of the colourless layer, a combination is used of 4,4'-Bis(tert-butoxycarbonyloxy)diphenylsulfone (CASRN 129104-70-7) as the H-donor-FG compound with the leuco dye crystal violet lactone (CASRN 1552-42-7).

3. Protonation of a Leuco Dye after a Re-Arrangement in a H-Donor-Precursor

The reaction mechanism can be represented by:

Leuco-dye+H-donor-RG→Leuco-dye+H-donor→Coloured Dye wherein RG represents a rearranging group.

A preferred H-donor-RG compound is capable of forming a compound having an allyl substituted phenol group as part of its chemical structure (the rest of the compound is represented by the group T) by laser heating:

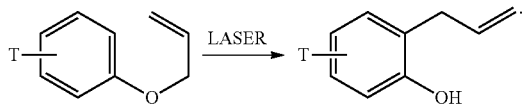

Preferred H-donor-RG compounds include 4-hydroxy-4'-allyloxy diphenylsulfone and 4,4'-diallyloxy diphenylsulfone whereof the synthesis is disclosed by EP 1452334 A (RICOH).

In contrast to the H-donor-FG compound of reaction mechanism 2, no compound having a melting temperature lower than room temperature (20° C.) is produced by the rearrangement of the H-donor-precursor to a hydrogen donor. Consequently, the security feature of blister formation as possible with the H-donor-FG compound cannot be produced by the H-donor-RG compounds.

The colour formation according to the mechanisms 2 and 3 above are two-component reactions involving a leuco dye and a hydrogen donor-precursor, i.e. a 'H-donor-FG compound' or 'H-donor-RG compound', while the first reaction mechanism is an one-component reaction. The advantage of using a two-component reaction for the colour formation is that the stability, especially the shelf-life stability, can be enhanced. The probability of undesired colour formation due to environment heating is decreased by going from a single step reaction to a two step reaction involving the formation of the H-donor followed by a reaction of the formed H-donor with the leuco dye.

The preferred colour formation mechanism is the protonation of a leuco dye after fragmentation of the H-donor since it includes both advantages of the blister formation security feature and the enhanced shelf-life stability.

In a preferred embodiment of the colourless layer, a combination is used of 4,4'-Bis(tert-butoxycarbonyloxy)diphenylsulfone (CASRN 129104-70-7) as the H-donor-FG compound with the leuco dye crystal violet lactone (CASRN 1552-42-7).

Infrared Absorbers

The infrared absorber used in the colourless colour forming layer of the colour laser marking method according to the present invention, can be an infrared dye, an infrared organic pigment and an inorganic infrared pigment, but preferably the infrared absorber is an infrared dye.

The advantage of using infrared dyes is that the absorption spectrum of an infrared dye tends to be narrower than that of an infrared pigment. This allows the production of multicoloured articles and security documents from precursors having a plurality of colourless layers containing different infrared dyes and colour forming compounds. The infrared dyes having a different $\lambda_{max}$ can then be addressed by infrared lasers with corresponding emission wavelengths causing colour formation only in the colourless layer of the addressed infrared dye.

Suitable examples of infrared dyes include, but are not limited to, polymethyl indoliums, metal complex IR dyes, indocyanine green, polymethine dyes, croconium dyes, cyanine dyes, merocyanine dyes, squarylium dyes, chalcogenopyryloarylidene dyes, metal thiolate complex dyes, bis(chalcogenopyrylo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, (metalized) azomethine dyes and combinations thereof.

Suitable inorganic infrared pigments include ferric oxide, carbon black and the like.

A preferred infrared dye is 5-[2,5-bis[2-[1-(1-methylbutyl)benz[cd]indol-2(1H)-ylidene]ethylidene]cyclopentylidene]-1-butyl-3-(2-methoxy-1-methylethyl)-2,4,6(1H,3H,5H)-pyrimidinetrione (CASRN 223717-84=8) represented by the Formula IR-1:

IR-1

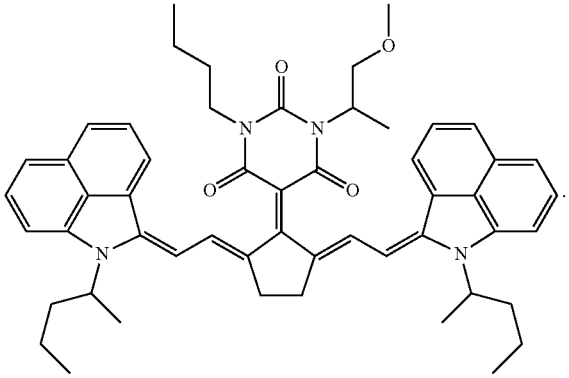

The infrared dye IR-1 has an absorption maximum $\lambda_{max}$ of 1052 nm making it very suitable for a Nd-YAG laser having an emission wavelength of 1064 nm.

The infrared red absorber is preferably present in the colourless colour forming layer in an amount of 0.05 to 1.0 g/m$^2$, more preferably in an amount of 0.1 to 0.5 g/m$^2$.

Thermal Acid Generating Compounds

The fragmentation of a colourless dye-precursor in the colourless colour forming layer of the colour laser marking method according to the present invention may be catalyzed or amplified by acids and acid generating agents.

Suitable thermal acid generating agents may be the polymeric acid generating agents based the ethylenically unsaturated polymerizable compounds A-(1) to A-(52) disclosed by U.S. Pat. No. 6,100,009 (FUJI) and herein incorporated as a specific reference.

Suitable non-polymeric acid generating agents are the compounds A-(1) to A-(52) disclosed by U.S. Pat. No. 6,100,009 (FUJI) lacking the ethylenically unsaturated polymerizable group.

The thermal acid generating agent is preferably present in the amount of 10 to 20 wt %, more preferably 14 to 16 wt % based on the total dry weight of the colourless layer.

Polymeric Binders

In principle any suitable polymeric binder that does not prevent the colour formation in the colourless layer of the colour laser marking method according to the present invention may be used. The polymeric binder may be a polymer, a copolymer or a combination thereof.

In a preferred embodiment, especially where the colourless layer includes a hydrogen donor-precursor and a leuco dye as the colour forming compound, the polymeric binder is a polymer or a copolymer of a chlorinated ethylene. The polymeric binder preferably includes at least 85 wt % of a chlorinated ethylene and 0 wt % to 15 wt % of vinyl acetate both based on the total weight of the polymeric binder. The polymeric binder preferably includes vinyl chloride as the chlorinated ethylene, and optionally vinylidene chloride as a second chlorinated ethylene.

In the most preferred embodiment of the invention, the polymeric binder includes at least 90 wt % of vinyl chloride based on the total weight of the polymeric binder.

The polymeric binder preferably includes at least at least 95 wt % of vinyl chloride and vinylacetate based on the total weight of the polymeric binder.

The polymeric binder is preferably present in the colourless colour forming layer in an amount of 5 to 30 g/m$^2$, more preferably in an amount of 7 to 20 g/m$^2$.

In the most preferred embodiment, the colourless layer in the method of colour laser marking an article according to the present invention includes 4,4'-Bis(tert-butoxycarbonyloxy) diphenylsulfone as hydrogen donor-precursor and crystal violet lactone as the colour forming compound and a copolymer of a chlorinated ethylene as polymeric binder.

Laser Markable Polymeric Supports

The laser markable polymeric support of the colour laser marking method according to the present invention is preferably selected from the group selected from polycarbonate, polyvinyl chloride, polystyrene, polystyrene acrylonitrile butadiene and copolymers thereof.

Laser marking produces a colour change from white to black in a laser markable support through carbonization of the polymer caused by local heating. Patent literature and other literature contain contradictory statements regarding the necessity of specific "laser additives" for one polymer or another. This is presumably because particular additives which are regularly added to plastics for other purposes (for example as a filler, for colouring or for flame retardation) can also promote the laser marking result. The literature particularly frequently mentions polycarbonate, polybutylene terephthalate (PBT) and Acrylonitrile Butadiene Styrene (ABS) as "laser markable even without additive", but additives are often added even in the case of these polymers in order to improve the laser markability further.

Laser Markable Layers

In the colour laser marking method according to the present invention, the laser markable layer preferably includes:

i) a laser additive; and ii) a polymer selected from the group consisting of polystyrene, polycarbonate and polystyrene acrylonitrile.

Laser additives, such as carbon black, are used in so minute concentration that they have practically no contribution to the colour of the laser markable layer.

The advantage of using a laser markable layer coated on a support instead of a laser markable support, is that a support can be used which has better physical properties than the laser markable supports, such as for example a higher flexibility than a polycarbonate support.

Suitable supports for the laser markable layer include those disclosed above in the next section on "Polymeric Foils". The support is preferably a polyethylene terephthalate glycol support (PETG) or a polyethylene terephthalate support (PET), more preferably a biaxially stretched polyethylene terephthalate support (PET-C), which may be transparent or opaque.

Suitable polymers include polycarbonate (PC), polyethylene terephthalate (PET), polybutylene terephthalate (PBT), polyvinyl chloride (PVC), polystyrene (PS) and copolymers thereof, such as e.g. aromatic polyester-carbonate and acrylonitrile butadiene styrene (ABS). A mixture of two or more of these polymers may also be used.

In order to promote and to support the colour change in polymeric materials, various additives have been developed. As a result of the addition of a "laser additive", a substance which absorbs the laser light and converts it to heat, the heat input and the carbonization can be improved. This is the case even for polymers such as polycarbonate which carbonize readily on their own. Laser markable plastics which are difficult to laser-treat include polyethylene, polypropylene, polyamide, polyoxymethylene, polyester, polymethyl methacrylate, polyurethane or a copolymer thereof.

Suitable laser additives include antimony metal, antimony oxide, carbon black, mica (sheet silicate) coated with metal oxides and tin-antimony mixed oxides. Suitable laser additives are additives based on various phosphorus-containing mixed oxides of iron, copper, tin and/or antimony as disclosed in WO 2006/042714 (TICONA).

In a preferred embodiment of the security document precursor, the laser markable layer contains carbon black particles as laser additive. This avoids the use of heavy metals, which are less desirable from an ecology point of view, in manufacturing these security documents, but may also cause problems for persons having a contact allergy based on heavy metals.

Suitable carbon blacks include Pigment Black 7 (e.g. Carbon Black MA8™ from MITSUBISHI CHEMICAL), Regal™ 400R, Mogul™ L, Elftex™ 320 from CABOT Co., or Carbon Black FW18, Special Black 250, Special Black 350, Special Black 550, Printex™ 25, Printex™ 35, Printex™ 55, Printex™ 90, Printex™ 150T from DEGUSSA.

The use of these laser additives may lead to an undesired background colouring of the security document. For example, a too high concentration of carbon black in a laser markable layer based on polycarbonate leads to grey security documents. If a white background is requested for the security document, then a white pigment may be added to the composition for manufacturing the laser markable layer. Preferably a white pigment with a refractive index greater than 1.60 is used. A preferred pigment is titanium dioxide.

However, most white pigments with a refractive index greater than 1.60, such as titanium dioxide, also have a high specific density resulting in problems of dispersion stability of the laser markable compositions used for making the laser markable layer. Both problems of white background and dispersion stability were solved in the present invention by using a dispersion of carbon black particles having a small average size and present in a low concentration.

The numeric average particle size of the carbon black particles is preferably between 5 nm and 250 nm, more preferably between 10 nm and 100 nm and most preferably between 30 nm and 60 nm. The average particle size of carbon black particles can be determined with a Brookhaven Instruments Particle Sizer BI90plus based upon the principle of dynamic light scattering. The measurement settings of the BI90plus are: 5 runs at 23° C., angle of 90°, wavelength of 635 nm and graphics=correction function.

For avoiding grey background colouring of security document, carbon black is preferably present in a concentration of less than 0.1 wt %, more preferably in the range 0.005 to 0.03 wt %, based on the total weight of the laser markable polymer(s).

Polymeric Foils

In the present invention, the colourless colour forming layer containing an infrared absorber, a polymeric binder and a colour forming compound is preferably coated on the polymeric foil, but may also be coated on the laser markable support.

The polymeric foil and/or the laser markable support may be provided with a subbing layer for improving the adhesion and coating quality.

The polymeric foil is preferably a biaxially stretched polyethylene terephthalate foil.

In a preferred embodiment, the polymeric foil is a transparent polymeric foil.

In a more preferred embodiment, the polymeric foil is a transparent biaxially stretched polyethylene terephthalate foil, optionally provided with a subbing layer.

In the present invention, the colourless colour forming layer containing an infrared absorber, a polymeric binder and a colour forming compound is preferably coated on a biaxially stretched polyethylene terephthalate foil, optionally provided with a subbing layer.

The transparency of the biaxially stretched polyethylene terephthalate foil is required so that the infrared laser light can reach the colourless colour forming layer and that information and graphical data, e.g. security print and guilloches, can be observed in and underneath the laser marked colourless colour forming layer(s).

Another advantage of using a biaxially stretched polyethylene terephthalate foil as the polymeric foil is that is very durable and resistant to mechanical influences (flexion, torsion, scratches), chemical substances, moisture and temperature ranges. This is especially useful for security documents such as identification cards and credit cards for which the average daily usage has lately augmented substantially from less than 1 time per week to 4 times per day. The card body has to withstand not only this increased usage, but also the associated storage conditions. Cards are no longer safely tucked away in cabinets at home or seldom-opened wallets, but are now loosely put away in pockets, purses, sport bags etc.—ready for immediate use. PVC (polyvinylchloride) is the most widely used material for plastic cards but has low durability of the card body, resulting in an effective lifetime of only 1-3 years, much lower than the lifetime of the often expensive chips included in the card. Other materials like Teslin™ and ABS are only suitable for very low-end or single-use cards. PC (polycarbonate) can be used for longer-life and more secure ID cards, but has a high production cost and a low resistance to torsion, scratching and chemicals.

The biaxially stretched polyethylene terephthalate foil (PET-C foil) should be sufficiently thick to be self-supporting, but thin enough so that it is possible to include other layers, foils and support within the format as specified for security documents, e.g. by ISO 7810 for identity cards. The thickness of the PET-C foil is preferably between 10 μm and 200 μm, more preferably between 10 μm and 100 μm, most preferably 30 μm and 65 μm.

The transparent polymeric foil with the at least one colourless colour forming layer may be laminated onto a support, e.g. the laser markable polymeric support or the support coated with the laser markable layer for generating a black colour, to form a security document precursor wherein the colourless colour forming layer is sandwiched between the transparent polymeric foil and the support. Additional foils and layers, e.g. other colourless colour forming layers having different infrared absorbers and colour forming compounds, may be included between the support and the transparent polymeric foil. In the case of a fully coloured security document, at least three colourless colour forming layers are present between the polymeric foil and the support so that e.g. CMYK colours can be formed.

In a preferred embodiment, the security document precursor is symmetrical, i.e. the same layers and foils are present on both sides of the support. This has the advantages that both sides can be full colour laser marked and that possible curl due to an asymmetric construction of the security document is effectively prevented.

In order to comply with the format as specified by ISO 7810 for security documents, the polymeric foil and the support have a thickness of between about 6 μm and about 250 μm, more preferably between about 10 μm and about 150 μm, most preferably between about 20 μm and about 100 μm.

In the case of a laser markable layer, the support can be transparent, translucent or opaque, and can be chosen from paper type and polymeric type supports well-known from photographic technology.

In a preferred embodiment the support is an opaque support. The advantage of an opaque support, preferably of a white colour, is that any information on the security document is more easily readable and that a colour image is more appealing. The support preferably is a single component extrudate, but may also be co-extrudate. Examples of suitable co-extrudates are PET/PETG and PET/PC. Paper type supports include plain paper, cast coated paper, polyethylene coated paper and polypropylene coated paper.

Suitable polymeric supports for a laser markable layer and polymeric foils include cellulose acetate propionate or cellulose acetate butyrate, polyesters such as polyethylene terephthalate and polyethylene naphthalate, polyamides, polycarbonates, polyimides, polyolefins, poly(vinylacetals), polyvinylchlorides, polyethers and polysulphonamides. Also synthetic paper can be used as a polymeric support, for example, Synaps™ synthetic paper of Agfa-Gevaert NV. Other examples of useful high-quality polymeric supports for the present invention include opaque white polyesters and extrusion blends of polyethylene terephthalate and polypropylene. Also Teslin™ may be used as support.

Polyester film supports for a laser markable layer and polymeric foils and especially polyethylene terephthalate are preferred because of their excellent properties of dimensional stability. When such a polyester is used as the support material, a subbing layer may be employed to improve the bonding of layers, foils and/or laminates to the support.

In a preferred embodiment of the security document precursor, the support is polyvinyl chloride, polycarbonate or polyester, with coloured or whitened polyvinyl chloride, polycarbonate or polyester being preferred. The polyester support is preferably polyethylene terephthalate support (PET) or polyethylene terephthalate glycol (PETG).

Instead of a coloured or whitened support, an opacifying layer can be coated onto the support. Such opacifying layer preferably contains a white pigment with a refractive index greater than 1.60, preferably greater than 2.00, and most preferably greater than 2.60. The white pigments may be employed singly or in combination. Suitable white pigments include C.I. Pigment White 1, 3, 4, 5, 6, 7, 10, 11, 12, 14, 17, 18, 19, 21, 24, 25, 27, 28 and 32. Preferably titanium dioxide is used as pigment with a refractive index greater than 1.60. Titanium oxide occurs in the crystalline forms of anatase type, rutile type and brookite type. In the present invention the rutile type is preferred because it has a very high refractive index, exhibiting a high covering power.

In one embodiment of the security document precursor, the support is an opacified polyvinyl chloride, an opacified polycarbonate or an opacified polyester.

The manufacturing of PET-C foils and supports is well-known in the art of preparing suitable supports for silver halide photographic films. For example, GB 811066 (ICI) teaches a process to produce biaxially oriented films of polyethylene terephthalate.

The polyethylene terephthalate supports and foils are preferably biaxially stretched with a stretching factor of at least 2.0, more preferably at least 3.0 and most preferably a stretching factor of about 3.5. The temperature used during stretching is preferably about 160° C.

Methods to obtain opaque biaxially oriented polyethylene terephthalate supports and foils have been disclosed in, e.g. US 2008238086 (AGFA).

Subbing Layers

The polymeric foil and support may be provided with one or more subbing layers. This has the advantage that the adhesion between a layer, such as the colourless layer, and the polymeric foil or support is improved. The transparent polymeric foil preferably includes a subbing layer whereon the colourless layer is coated.

Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The application of subbing layers is well-known in the art of manufacturing polyester supports for silver halide photographic films. For example, the preparation of such subbing layers is disclosed in U.S. Pat. No. 3,649,336 (AGFA) and GB 1441591 (AGFA);

Suitable vinylidene chloride copolymers include: the copolymer of vinylidene chloride, N-tert.-butylacrylamide, n-butyl acrylate, and N-vinyl pyrrolidone (e.g. 70:23:3:4), the copolymer of vinylidene chloride, N-tert.-butylacrylamide, n-butyl acrylate, and itaconic acid (e.g. 70:21:5:2), the copolymer of vinylidene chloride, N-tert.-butylacrylamide, and itaconic acid (e.g. 88:10:2), the copolymer of vinylidene chloride, n-butylmaleimide, and itaconic acid (e.g. 90:8:2), the copolymer of vinyl chloride, vinylidene chloride, and methacrylic acid (e.g. 65:30:5), the copolymer of vinylidene chloride, vinyl chloride, and itaconic acid (e.g. 70:26:4), the copolymer of vinyl chloride, n-butyl acrylate, and itaconic acid (e.g. 66:30:4), the copolymer of vinylidene chloride, n-butyl acrylate, and itaconic acid (e.g. 80:18:2), the copolymer of vinylidene chloride, methyl acrylate, and itaconic acid (e.g. 90:8:2), the copolymer of vinyl chloride, vinylidene chloride, N-tert.-butylacrylamide, and itaconic acid (e.g. 50:30:18:2). All the ratios given between brackets in the above-mentioned copolymers are ratios by weight.

In a preferred embodiment, the subbing layer has a dry thickness of no more than 2 μm or preferably no more than 200 mg/m$^2$.

Organic Solvents

For coating the laser markable colourless layer, one or more organic solvents may be used. The use of an organic solvent facilitates the dissolution of the polymeric binder and specific ingredients such as the infrared dye.

A preferred organic solvent is methyl ethyl ketone (MEK) because it combines a high solubilizing power for a wide range of ingredients and it provides, on coating the colourless layer, a good compromise between the fast drying of the colourless layer(s) and the danger of fire or explosion thereby allowing high coating speeds.

Other Security Features

To prevent forgeries of identification documents, different means of securing are used. One solution consists in superimposing lines or guilloches on an identification picture such as a photograph. In that way, if any material is printed subsequently, the guilloches appear in white on added black background. Other solutions consist in adding security elements such as information printed with ink that reacts to ultraviolet radiation, micro-letters concealed in an image or text etc.

The security document according to the present invention may contain other security features such as anti-copy patterns, guilloches, endless text, miniprint, microprint, nanoprint, rainbow colouring, 1D-barcode, 2D-barcode, coloured fibres, fluorescent fibres and planchettes, fluorescent pigments, OVD and DOVID (such as holograms, 2D and 3D holograms, Kinegrams™, overprint, relief embossing, perforations, metallic pigments, magnetic material, Metamora colours, microchips, RFID chips, images made with OVI (Optically Variable Ink) such as iridescent and photochromic ink, images made with thermochromic ink, phosphorescent pigments and dyes, watermarks including duotone and multitone watermarks, ghost images and security threads.

A combination of the security document according to the present invention with one of the above security features increases the difficulty for falsifying the document.

EXAMPLES

Materials

All materials used in the following examples were readily available from standard sources such as ALDRICH CHEMICAL Co. (Belgium) and ACROS (Belgium) unless otherwise specified. The water used was deionized water.

Hydran™ APX101H is a waterbased liquid of ionomer type polyester urethane using polyester segments based on terephthalic acid and ethylene glycol and hexamethylene diisocyanate available from DIC Europe GmbH.

Resorcinol from Sumitomo Chemicals.

Resor-sol is a 7.4 wt % aqueous solution of resorcinol (pH 8).

Par is a dimethyltrimethylolamine formaldehyde resin from Cytec industries.

PAR-sol is a 40 wt % aqueous solution of Par.

PEA is Tospearl 120 from Momentive Performance materials.

PEA-sol is a 10 wt % (50/50) aqueous/ethanol dispersion of PEA.

Dowfax™ 2A1 from Pilot Chemicals C is a alkyldiphenyloxide disulfonate (4.5% wt %).

DOW-sol is a 2.5 wt % solution of Dowfax™ 2A1 in isopropanol.

MEK is an abbreviation used for methyl ethyl ketone.

Sunvac™ HH is a copolymer of 86 wt % vinyl chloride and 14 wt % vinyl acetate provided by Yantal Suny Chem International Co., Ltd, China.

Baysilon is the silicon oil Baysilon™ Lackadditive MA available from BAYER.

HDP is the hydrogen donor-precursor CASRN 129104-70-7 prepared according to the synthesis given on page 31 of EP 605149 A (JUDO PAPER) for the compound (19).

CVL is crystal violet lactone (CASRN 1552-42-7), a blue colour forming compound available from Pharmorgana:

CVL

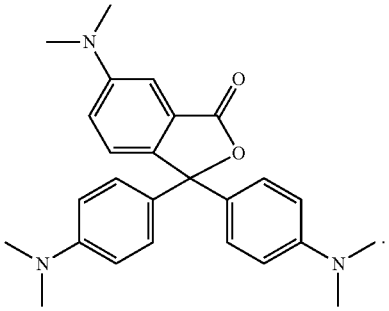

Solbin™ A is a copolymer of 92% vinyl chloride, 3% vinyl acetate and 5% vinyl alcohol from NISSIN CHEMICAL Co.

T04 is A polyethylene terephthalate polymer from Agfa-Gevaert NV having a $T_g$ of 80.5° C., an inherent viscosity of 0.60 dl/g and a melt flow index of 34.8 mL/10 min at 270° C./1.20 kg, wherein the inherent viscosity was determined in a 0.5 g/dL solution of 60 wt % phenol and 40 wt % ortho-dichlorobenzene at 25° C. in an Ubbelohde viscometer.

SAN 124 is a styrene acrylonitrile copolymer from DOW Chemical including 28.5 wt % acrylonitrile and 71.5 wt % styrene, with a $M_n$ of 53,940, a $M_w$ of 109,350, a $T_g$ of 108.1° C. and a melt flow index of 37.9 mL/10 min at 270° C./1.20 kg.

$TiO_2$ is Renol-white/PTX 506, a masterbatch from CLARIANT GmbH containing 65% by weight $TiO_2$ and 35 wt % polyester.

BS is an abbreviation used for a 10 wt % solution in MEK of the silicon oil Baysilon™ OI A available from BAYER and used as a surfactant.

Sartomer™ CD561 is alkoxylated hexanediol diacrylate from SARTOMER.

Empera™ 171M is a polystyrene available from INEOS.

Zylar™ 631 is a copolymer of styrene, butadiene and methyl methacrylate from INEOS NOVA SERVICES BV.

TPO is an abbreviation used for a 10 wt % solution in MEK of 2,4,6-trimethylbenzoyl-diphenyl-phosphineoxide available under the trade name Darocur™ TPO from CIBA SPECIALTY CHEMICALS.

PS-sol is 30 wt % solution of Empera™ 171M in MEK.

Special Black™ 25 is a carbon black having a primary particle size of about 56 nm and BET Surface area of 45 $m^2/g$ available from EVONIK (DEGUSSA).

IR-1 is the infrared dye with CASRN 223717-84-8 which was prepared as described below.

The synthesis of intermediate INT-5 was carried out in a cascade mode without purification of the intermediates INT-1, INT-2, INT-3 and INT-4 as described below:

Intermediate INT-1

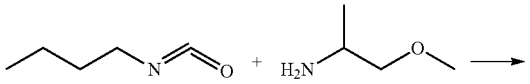

-continued

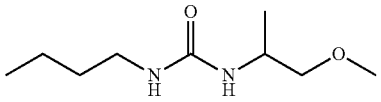

INT-1

To a solution of butyl isocyanate (1.03 eq.) in toluene (70 mL/mol) at 50° C. was added 2-amino-1-methoxy propane (1.00 eq.) over a 2 hour period. After stirring for 30 minutes, excess toluene and reagent were distilled off at 85° C./50 mbar and at 85° C./20 mbar respectively. The mixture was allowed to reach atmospheric pressure under nitrogen.

Intermediate INT-2

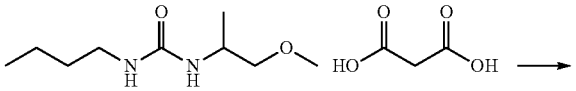

INT-1

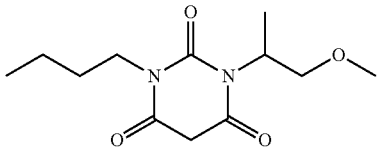

INT-2

To the warm residue (INT-1) were consecutively added: acetic acid (140 mL/mol), malonic acid (1.00 eq.) and acetic anhydride (2.00 eq.). Under stirring the reaction mixture was gently warmed to 90° C. After stirring for 2.5 hours at 90° C., methanol (70 mL/mol) was added and the mixture was refluxed for 45 minutes. Subsequently, the solvents were removed at 100° C./70 mbar. After cooling to 30° C., methyl t. butyl ether (MTBE) (300 mL/mol) was added. This mixture was extracted 3× with a 5% NaCl solution in water and 2× with a satured NaCl solution in water. The MTBE was distilled off at 95° C./70 mbar. The remaining water was azeotropically removed with toluene. The mixture was allowed to reach room temperature under nitrogen at atmospheric pressure.

Intermediate INT-3

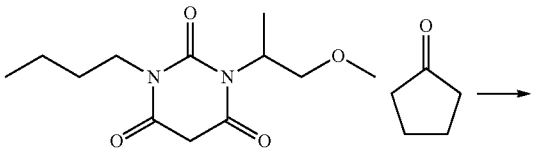

INT-2

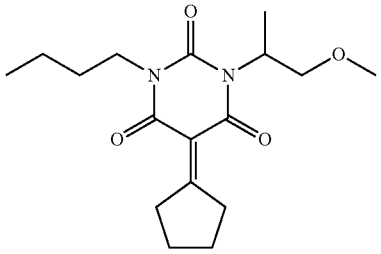

INT-3

To the residue (INT-2) were consecutively added under a nitrogen blanket at room temperature: cyclopentanone (1.10 eq.), ammoniumacetate (0.07 eq.) and methanol (150 mL/mol). After refluxing for 4.5 hours, methanol was distilled off at 50 mbar. Remaining methanol and water were azeotropically removed with toluene. After cooling to room temperature, toluene (0.108 kg/mol) was added. This solution was filtered on a stainless steel filter covered with silica (30 g/mol). The reactor and the filter cake were washed with toluene (4×50 mL/mol). This solution of INT-3 was directly used in the next step Intermediate INT-4

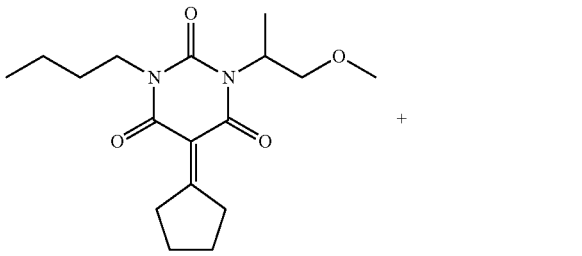

INT-3

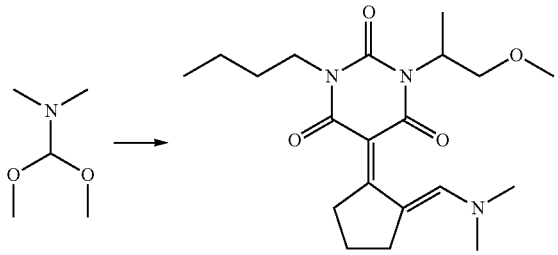

INT-4

To the toluene solution of INT-3 at room temperature was added acetic acid (1.00 eq.). Under a nitrogen blanket, DMF-DMA (1.13 eq.) was quickly (10 minutes) added at 10° C. After 5 minutes, n. hexane (830 mL/mol) was added, followed by another portion of n. hexane (415 mL/mol) after 30 minutes. After stirring for at least 1 hour (crystallisation) INT-4 is collected by filtration. After washing with n. hexane/toluene (100 mL/mol) and n. hexane (3×125 mL/mol), the product INT-4 was digested with n. hexane (500 mL/mol), filtered and dried at 25° C. for 24 hours.

Intermediate INT-5

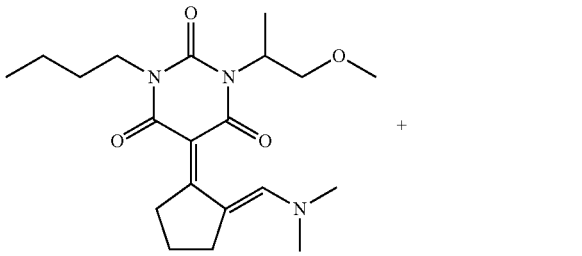

INT-4

-continued

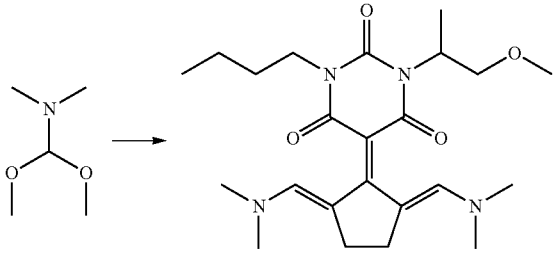

INT-5

To a suspension of INT-4 in ethyl acetate (320 mL/mol) under nitrogen at room temperature was added DMF-DMA (3.49 eq.) in one portion. The mixture was heated to 65° C. and stirred at 65° C. for 25 minutes. While quickly cooling to 15° C., a mixture of MTBE (640 mL/mol) and n. hexane (160 mL/mol) was added. After stirring for 15 minutes, the product was filtered and consecutively washed with ethylacetate/MTBE 80/20 (200 mL/mol), ethylacetate/n. hexane 80/20 (200 mL/mol), ethylacetate/n. hexane 50/50 (200 mL/mol) and n. hexane (200 mL/mol). The rather unstable product (INT-5) was dried at 25° C. for 24 hours.

The synthesis of intermediate INT-7 was carried out in a cascade mode without purification of the intermediate INT-6 as described below:

Intermediate INT-6

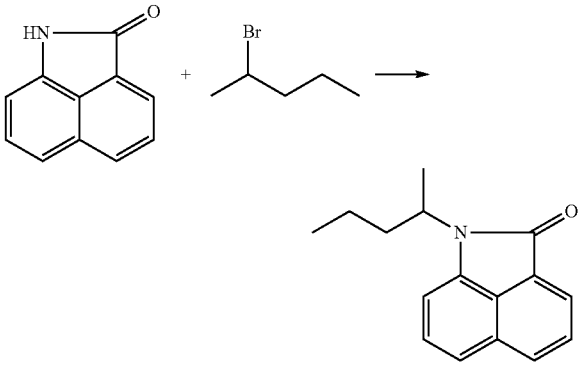

INT-6

To a nitrogen blanketed solution of 1,8-Naphtholactam (1.00 eq.) in sulfolane (250 mL/mol) at 70° C. were added potassium iodide (0.20 eq.) and dimethylaminopyridine (DMAP) (0.135 eq.).

To this mixture was added potassium hydroxide (KOH) (0.60 eq.) and 2-bromo pentane (0.50 eq.).

After 1 hour at 70-75° C. another portion of KOH (0.60 eq.) and 2-bromo pentane (0.50 eq.) were added, while distilling of the pentene side product. This was repeated 2 times. After cooling the reaction mixture was diluted with MTBE (1 L/mol) and washed with water. The water layer was extracted again with MTBE. The combined extracts were washed consecutively with a 15% NaCl solution in water, a 10% NaCl solution in water containing 4% HCl, a 15% NaCl solution in water containing 1% NaHCO3 and a 25% NaCl solution in water. The MTBE was distilled off and the remaining water was azeotropically removed with toluene. The crude INT-6 (oil) was used a such.

Intermediate INT-7

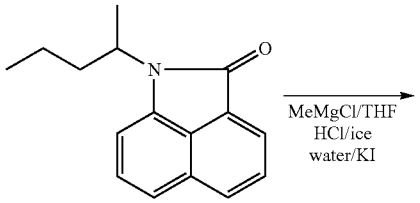

INT-6

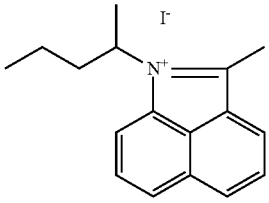

INT-7

To nitrogen blanketed solution of INT-6 (1.00 eq.) in THF (100 mL/mol) at room temperature was added methyl magnesiumchloride (1.28 eq.) over 45 minutes (55-60° C.). After stirring for 1 hour at 55° C., the reaction mixture was added to a mixture of HCl (3.9 eq.) in ice water (3.66 kg/mol). After distillative removal of the THF, the aqueous solution was filtered and added to a solution of KI (2.00 eq.) in water (2.1 L/mol). After crystallisation, crude INT-7 was filtered and consecutively washed with water (2.55 L/mol) and ethyl acetate (2.55 L/mol) and dried at 40° C. Yield: 76%

Infrared Dye IR-1

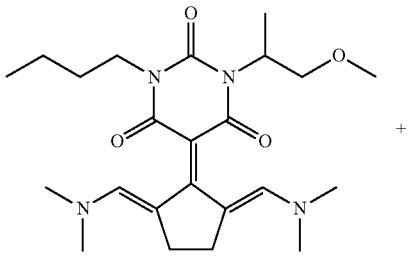

INT-5

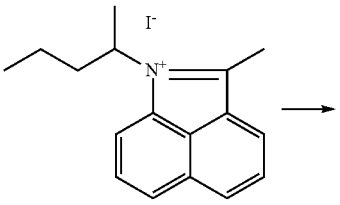

INT-7

-continued

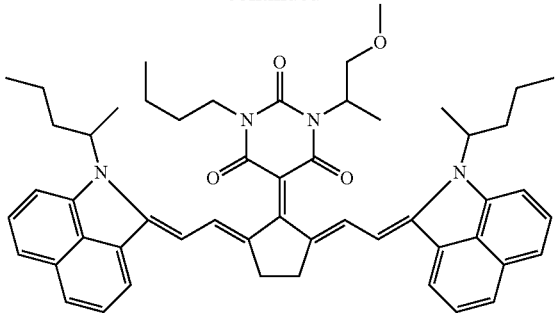

IR-1

To a stirred suspension of INT-5 (1.00 eq.) in methyl acetate (4 L/mol) at 50° C., was added in portions INT-7 (2.10 eq.) over 5 minutes. After stirring for 1 hour at 55° C., 2 extra portions of INT-7 (each 0.016 eq.) were added. After stirring for 2.5 hours at 55° C., the reaction mixture was cooled to room temperature. Crude IR-1 was isolated by filtration and washed with ethyl acetate (4 L/mol).

After digestion in water (to remove salts) (4 L/mol), filtering and washing on the filter with water (2 L/mol) and MTBE (1.5 L/mol) the product was dried at 40° C. Yield=92%.

LMB2 is PETix™ OLE 100, a laminate available from Agfa-Gevaert NV including a 100 μm thick biaxially stretched polyethylene terephthalate with a laser markable layer for generating a black colour.

LMB3 is 100 TRL 6-2, a 95 μm thick laminate available from Austria Card GmbH including a laser markable polycarbonate foil for generating a black colour.

LMB4 is PETix™ LE 100, a coextruded PETG/Polycarbonate/PETG laminate available from Agfa-Gevaert NV which can be lasermarked to generate a black colour.

LMO5 is PETix™ OL 60, a laminate available from Agfa-Gevaert NV including a 100 μm thick biaxially stretched polyethylene terephthalate with a laser markable layer for generating a black colour.

LMS1 is a 150 μm thick PETG foil available as PETG CF 150 from Agfa-Gevaert NV.

LMS2 is a 300 μm thick PETG foil available as PETG CF 300 from Agfa-Gevaert NV.

Measurement Methods

1. Optical Density

The optical density was measured in reflection using a spectrodensitometer Type Macbeth TR924 using a visual filter.

Example 1

This example illustrates the formation of black and blue coloured markings of different optical densities by using the same infrared laser in a pulsed mode at different pulse repetition rates on different security document precursors.

Preparation of PET-C foils PET1 and PET2

A coating composition SUB-1 was prepared by mixing the components according to Table 1 using a dissolver.

TABLE 1

| Components of SUB-1 | Volume (mL) |
|---|---|
| water | 700.9 |
| Hydran ™ APX101H | 146.6 |
| Resor-sol | 125.0 |

TABLE 1-continued

| Components of SUB-1 | Volume (mL) |
|---|---|
| PAR-sol | 5.0 |
| PEA-sol | 7.5 |
| DOW-sol | 15.0 |

A 1100 μm thick transparent polyethylene terephthalate sheet was first longitudinally stretched and then a subbing layer was coated on one side of the sheet using the coating composition SUB-1 to a wet thickness of 10 μm. After drying, the longitudinally stretched and coated polyethylene terephthalate sheet was transversally stretched to produce a 63 μm thick sheet PET1, which was transparent and glossy.

A second 1100 μm thick transparent polyethylene terephthalate sheet was first longitudinally stretched and a subbing layer was coated on both sides of the sheet using the coating composition SUB-1 to a wet thickness of 10 μm. After drying, the longitudinally stretched and coated polyethylene terephthalate sheet was transversally stretched to produce a 63 μm thick sheet PET2, which was transparent and glossy.

Preparation of Laminates LMC1A and LMC1B

The laminates LMC1A and LMC1B include a PET-C foil and a colourless colour forming layer for generating a blue colour.

The coating compositions COL-1 and ADH-1 were prepared by mixing the components according to Table 2 respectively Table 3 using a dissolver.

TABLE 2

| Components of COL-1 | wt % |
|---|---|
| Baysilon | 1.20 |
| MEK | 31.32 |
| Sunvac ™ HH | 39.98 |
| IR-1 | 23.33 |
| HDP | 2.17 |
| CVL | 2.00 |

TABLE 3

| Components of ADH-1 | wt % |
|---|---|
| MEK | 87.5 |
| Solbin ™ A | 12.5 |

The coating composition COL-1 was coated with an Elcometer™ Bird Film Applicator (from ELCOMETER INSTRUMENTS) on the subbing layer of the subbed PET-C support PET1 at a coating thickness of 100 μm and subsequently dried for 2 minutes at 20° C. on the film applicator and for a further 15 minutes in an oven at 75° C. to deliver the laminate LMC1A.

A second laminate was prepared by first coating the coating composition COL-1 with the Elcometer™ Bird Film Applicator on of the subbing layers of the subbed PET-C support PET2 at a coating thickness of 100 μm and subsequently drying for 2 minutes at 20° C. on the film applicator and for a further 15 minutes in an oven at 75° C. Then a thermoadhesive layer was applied by coating the coating composition ADH-1 with the Elcometer™ Bird Film Applicator on the other subbing layer of the subbed PET-C support PET2 at a coating thickness of 100 μm and subsequently drying for 2 minutes at 20° C. on the film applicator and for a further 15 minutes in an oven at 75° C. to deliver the laminate LMC1B.

Preparation of Laser Additive Dispersion LAD-1B

A concentrated carbon black dispersion LAD-1 was prepared by dissolving 300.0 g of PS-sol in a vessel containing 127.5 g of MEK using a DISPERLUX™ disperser (from DISPERLUX S.A.R.L., Luxembourg). and 22.5 g of Special Black™ 25 was added to the solution and stirred for 30 minutes. The vessel was then connected to a NETZSCH ZETAMILL filled having its internal volume filled for 50% with 0.4 mm yttrium stabilized zirconia beads ("high wear resistant zirconia grinding media" from TOSOH Co.). The mixture was circulated over the mill for 1 hour at a rotation speed in the mill of about 10.4 m/s (3,000 rpm). 290 g of the concentrated laser additive dispersion LAD-1 was recovered.

8.0 g of the concentrated laser additive dispersion LAD-1 was then added to a plastic bottle of 2,000 mL containing 659.0 g of MEK and 333.0 g of PS-sol. This mixture was put onto a roller mill without using beads for 1 hour at a rotation speed set at 150 rpm to deliver the laser additive dispersion LAD-1B containing 2,000 ppm of Special Black™ 25.

Preparation of Laminate LMB6

For producing an opaque white PET-C foil including a laser markable layer for generating a black colour, a mixture WPM-1 was prepared by mixing the components according to Table 4 and then drying the mixture at 150° C. for 4 hours under vacuum (<100 mbar) before melting in a PET-extruder, extrusion through a sheet die and cooling to produce a 1100 μm thick extrudate having a density of 1.3 g/mL.

TABLE 4

| Components of WPM-1 | wt % |
|---|---|
| T04 | 83 |
| SAN 124 | 15 |
| $TiO_2$ | 2 |

The 1100 μm thick extruded sheet was first longitudinally stretched and a subbing layer was coated on both sides of the sheet using the coating composition SUB-1 to a wet thickness of 10 μm. After drying, the longitudinally stretched and coated sheet was transversally stretched to produce a 105 μm thick opaque white sheet PET3.

The coating compositions CC-1 and CC-2 were prepared by mixing the components in the order according to Table 5.

TABLE 5

| | Coating Compositions | |
|---|---|---|
| wt % of | CC-1 | CC-2 |
| BS | 0.10 | 0.29 |
| MEK | 87.16 | 59.89 |
| Empera ™ 171M | 7.42 | 21.49 |
| Zylar ™ 631 | 1.11 | 3.22 |
| LAD-1B | — | 2.90 |
| Sartomer ™ CD561 | 3.01 | 8.71 |
| TPO | 1.20 | 3.50 |

The coating composition CC-1 was then coated with an Elcometer™ Bird Film Applicator (from ELCOMETER INSTRUMENTS) on one side of the subbed opaque white sheet PET3 at a coating thickness of 100 μm and subsequently dried for 1.5 minutes at 50° C. The coated sheet was partially cured using a Fusion DRSE-120 conveyer, equipped with a Fusion VPS/I600 lamp (D-bulb), which transported it under the UV-lamp on a conveyer belt at a speed of 20 m/min for a UV exposure of 250 mJ/$m^2$.

The coating composition CC-2 was then coated on top of the layer coated from the coating composition CC-1 using the Elcometer™ Bird Film Applicator (from ELCOMETER INSTRUMENTS) at a coating thickness of 100 μm and subsequently dried for 15 minutes at 50° C. The coated sheet was partially cured using a Fusion DRSE-120 conveyer, equipped with a Fusion VPS/I600 lamp (D-bulb), which transported it under the UV-lamp on a conveyer belt at a speed of 20 m/min for a UV exposure of 250 mJ/m$^2$.

On the opposite side of the sheet coated with the coating compositions CC-1 and CC-2, a thermoadhesive layer was coated using a coating composition ADH-1 according to Table 3. The coating was performed with the Elcometer™ Bird Film Applicator (from ELCOMETER INSTRUMENTS) at a coating thickness of 80 μm and then subsequently dried for 15 minutes at 50° C. The coated sheet was then cured using a Fusion DRSE-120 conveyer, equipped with a Fusion VPS/I600 lamp (D-bulb), which transported it three times under the UV-lamp on a conveyer belt at a speed of 20 m/min for a UV exposure of 250 mJ/m$^2$ to deliver the laminate LMB6 including a laser markable layer for generating a black colour.

Preparation of Security Document Precursor SDP-1

A security document precursor SDP-1 was prepared by laminating the laminate sandwich as given by Table 6 wherein the laminates LMC1B are oriented with the colourless colour forming layer facing the foil LMS2. The lamination was performed using an Oasys OLA6/7 plate laminator with the settings: LPT=130° C., LP=40, Hold=210 sec, HPT=130° C., HP=40 and ECT=50° C.

TABLE 6

| |
|---|
| Laminate LMO5 (Overlay) |
| Laminate LMB4 (Black colour formation) |
| Laminate LMC1B (Blue colour formation) |
| Foil LMS2 (Support) |
| Laminate LMC1B (Blue colour formation) |
| Laminate LMB4 (Black colour formation) |
| Laminate LMO5 (Overlay) |

Preparation of Security Document Precursor SDP-2

A security document precursor SDP-2 was prepared by laminating the laminate sandwich as given by Table 7 wherein the laminates LMC1A are oriented with the colourless colour forming layer facing the laminates LMB4. The lamination was performed using an Oasys OLA6/7 plate laminator with the settings: LPT=130° C., LP=40, Hold=210 sec, HPT=130° C., HP=40 and ECT=50° C.

TABLE 7

| |
|---|
| Laminate LMC1A (Blue colour formation) |
| Laminate LMB4 (Black colour formation) |
| Foil LMS1 (Support) |
| Foil LMS1 (Support) |
| Foil LMS1 (Support) |
| Laminate LMB4 (Black colour formation) |
| Laminate LMC1A (Blue colour formation) |

Preparation of Security Document Precursor SDP-3

A security document precursor SDP-3 was prepared by laminating the laminate sandwich as given by Table 8 wherein the laminates LMC1A are oriented with the colourless colour forming layer facing the laminates LMB3. The lamination was performed using an Oasys OLA6/7 plate laminator with the settings: LPT=130° C., LP=40, Hold=210 sec, HPT=130° C., HP=40 and ECT=50° C.

TABLE 8

| |
|---|
| Laminate LMC1A (Blue colour formation) |
| Laminate LMB3 (Black colour formation) |
| Foil LMS1 (Support) |
| Foil LMS1 (Support) |
| Foil LMS1 (Support) |
| Laminate LMB3 (Black colour formation) |
| Laminate LMC1A (Blue colour formation) |

Preparation of Security Document Precursor SDP-4

A security document precursor SDP-4 was prepared by laminating the laminate sandwich as given by Table 9 wherein the laminates LMC1B are oriented with the colourless colour forming layer facing the foils LMS1. The lamination was performed using an Oasys OLA6/7 plate laminator with the settings: LPT=130° C., LP=40, Hold=210 sec, HPT=130° C., HP=40 and ECT=50° C.

TABLE 9

| |
|---|
| Laminate LMB2 (Black colour formation) |
| Laminate LMC1B (Blue-colour formation) |
| Foil LMS1 (Support) |
| Foil LMS1 (Support) |
| Foil LMS1 (Support) |
| Laminate LMC1B (Blue colour formation) |
| Laminate LMB2 (Black colour formation) |

Preparation of Security Document Precursor SDP-5

A security document precursor SDP-5 was prepared by laminating the laminate sandwich as given by Table 10 wherein the laminates LMC1A are oriented with the colourless colour forming layer facing the laminates LMB6. The lamination was performed using an Oasys OLA6/7 plate laminator with the settings: LPT=130° C., LP=40, Hold=210 sec, HPT=130° C., HP=40 and ECT=50° C.

TABLE 10

| |
|---|
| Laminate LMC1A (Blue colour formation) |
| Laminate LMB6 (Black colour formation) |
| Foil LMS1 (Support) |
| Foil LMS1 (Support) |
| Foil LMS1 (Support) |
| Laminate LMB6 (Black colour formation) |
| Laminate LMC1A (Blue colour formation) |

Evaluation and Results

Before laser exposure, the security document precursors SDP-1 to SDP-5 all had a minimum optical density of about 0.25.

A test image containing a wedge with different grey-levels (six squares of 9×9 mm) was laser marked on the security document precursors SDP-1 to SDP-5, using a CLP 54 card laser personalization system from Mühlbauer AG in combination with the VisualLaserMarker Version 4.1 software from ROFIN-SINAR Laser GmbH and the settings of frequency (=pulse repetition rate) and current as shown in Table 11.

The maximum optical density was measured in squares 4 and 6. In some cases blister formation was observed when a too high current was employed. The colour of the wedge was evaluated. An evaluation "Mix" means that some squares of the wedge exhibited a black colour while other squares were blue or some squares exhibited a mixture of blue and black colour. All results are shown in Table 11.

TABLE 11

| Sample | SDP | Frequency (Hz) | Current (Ampere) | Blister | Optical Density Square 4 | Optical Density Square 6 | Colour |
|---|---|---|---|---|---|---|---|
| 1 | SDP-1 | 60000 | 35 | No | 0.30 | 0.34 | Blue |
| 2 | SDP-1 | 45000 | 35 | No | 0.38 | 0.75 | Blue |
| 3 | SDP-1 | 45000 | 33 | No | 0.37 | 0.84 | Blue |
| 4 | SDP-1 | 45000 | 29 | No | 0.34 | 0.44 | Blue |
| 5 | SDP-1 | 40000 | 35 | No | 0.42 | 0.70 | Blue |
| 6 | SDP-1 | 35000 | 35 | No | 0.50 | 0.88 | Blue |
| 7 | SDP-1 | 30000 | 31 | Yes | 0.43 | 0.98 | Blue |
| 8 | SDP-1 | 25000 | 27 | Yes | 0.40 | 0.89 | Blue |
| 9 | SDP-1 | 20000 | 33 | Yes | 0.86 | 1.46 | Blue |
| 10 | SDP-1 | 20000 | 31 | No | 0.62 | 1.24 | Blue |
| 11 | SDP-1 | 15000 | 33 | Yes | 0.97 | 1.09 | Blue |
| 12 | SDP-1 | 15000 | 29 | No | 0.55 | 1.06 | Mix |
| 13 | SDP-1 | 15000 | 27 | No | 0.50 | 0.78 | Black |
| 14 | SDP-1 | 5000 | 31 | Yes | 0.69 | 1.18 | Black |
| 15 | SDP-1 | 5000 | 29 | No | 0.58 | 0.78 | Black |
| 16 | SDP-1 | 3000 | 29 | No | 0.64 | 1.15 | Black |
| 17 | SDP-1 | 3000 | 27 | No | 0.52 | 0.82 | Black |
| 18 | SDP-1 | 2000 | 29 | No | 0.69 | 1.21 | Black |
| 19 | SDP-1 | 2000 | 27 | No | 0.59 | 0.82 | Black |
| 20 | SDP-1 | 1000 | 29 | No | 0.62 | 1.07 | Black |
| 21 | SDP-1 | 1000 | 27 | No | 0.54 | 0.81 | Black |
| 22 | SDP-1 | 500 | 29 | No | 0.68 | 1.10 | Black |
| 23 | SDP-1 | 500 | 27 | No | 0.61 | 0.86 | Black |
| 24 | SDP-2 | 60000 | 35 | No | 0.34 | 0.45 | Blue |
| 25 | SDP-2 | 55000 | 35 | No | 0.33 | 0.50 | Blue |
| 26 | SDP-2 | 50000 | 35 | No | 0.38 | 0.89 | Blue |
| 27 | SDP-2 | 45000 | 35 | No | 0.41 | 0.93 | Blue |
| 28 | SDP-2 | 30000 | 33 | No | 0.62 | 1.12 | Blue |
| 29 | SDP-2 | 30000 | 31 | No | 0.43 | 0.98 | Blue |
| 30 | SDP-2 | 25000 | 31 | No | 0.52 | 1.11 | Blue |
| 31 | SDP-2 | 20000 | 35 | No | 0.87 | 1.08 | Blue |
| 32 | SDP-2 | 15000 | 35 | No | 0.94 | 1.12 | Blue |
| 33 | SDP-2 | 15000 | 31 | No | 0.73 | 1.10 | Mix |
| 34 | SDP-2 | 15000 | 29 | No | 0.61 | 0.89 | Mix |
| 35 | SDP-2 | 10000 | 29 | No | 0.64 | 0.94 | Mix |
| 36 | SDP-2 | 5000 | 35 | No | 0.97 | 0.98 | Black |
| 37 | SDP-2 | 5000 | 33 | No | 0.75 | 0.88 | Black |
| 38 | SDP-2 | 5000 | 27 | No | 0.52 | 0.9 | Black |
| 39 | SDP-2 | 3000 | 29 | No | 0.69 | 1.16 | Black |
| 40 | SDP-2 | 3000 | 27 | No | 0.60 | 0.89 | Black |
| 41 | SDP-2 | 2000 | 29 | No | 0.68 | 1.12 | Black |
| 42 | SDP-2 | 2000 | 27 | No | 0.61 | 0.84 | Black |
| 43 | SDP-2 | 1000 | 33 | No | 1.24 | 1.56 | Black |
| 44 | SDP-2 | 1000 | 31 | No | 1.03 | 1.61 | Black |
| 45 | SDP-2 | 500 | 31 | No | 1.16 | 1.71 | Black |
| 46 | SDP-2 | 500 | 29 | No | 0.94 | 1.61 | Black |
| 47 | SDP-3 | 60000 | 35 | No | 0.34 | 0.46 | Blue |
| 48 | SDP-3 | 55000 | 35 | No | 0.36 | 0.53 | Blue |
| 49 | SDP-3 | 50000 | 35 | No | 0.50 | 0.73 | Blue |
| 50 | SDP-3 | 45000 | 35 | No | 0.50 | 0.84 | Blue |
| 51 | SDP-3 | 40000 | 35 | No | 0.84 | 0.82 | Blue |
| 52 | SDP-3 | 25000 | 35 | No | 0.62 | 1.16 | Blue |
| 53 | SDP-3 | 20000 | 29 | No | 0.68 | 1.21 | Blue |
| 54 | SDP-3 | 15000 | 35 | No | 1.22 | 1.05 | Blue |
| 55 | SDP-3 | 15000 | 27 | No | 0.62 | 1.00 | Mix |
| 56 | SDP-3 | 10000 | 29 | No | 0.83 | 1.22 | Mix |
| 57 | SDP-3 | 10000 | 27 | No | 0.61 | 1.17 | Mix |
| 58 | SDP-3 | 5000 | 29 | No | 0.77 | 0.99 | Mix |
| 59 | SDP-3 | 5000 | 27 | No | 0.59 | 1.20 | Black |
| 60 | SDP-3 | 3000 | 25 | No | 0.78 | 1.03 | Black |
| 61 | SDP-3 | 3000 | 23 | No | 0.70 | 1.00 | Black |
| 62 | SDP-3 | 2000 | 27 | No | 0.74 | 1.05 | Black |
| 63 | SDP-3 | 2000 | 25 | No | 0.63 | 1.01 | Black |
| 64 | SDP-3 | 1000 | 27 | No | 0.63 | 0.99 | Black |
| 65 | SDP-3 | 1000 | 25 | No | 0.64 | 0.86 | Black |
| 66 | SDP-3 | 500 | 27 | No | 0.72 | 0.99 | Black |
| 67 | SDP-3 | 500 | 25 | No | 0.63 | 0.95 | Black |
| 68 | SDP-4 | 60000 | 35 | No | 0.34 | 0.44 | Blue |
| 69 | SDP-4 | 55000 | 35 | No | 0.34 | 0.45 | Blue |
| 70 | SDP-4 | 50000 | 35 | No | 0.35 | 0.83 | Blue |
| 71 | SDP-4 | 45000 | 35 | No | 0.38 | 1.03 | Blue |
| 72 | SDP-4 | 40000 | 35 | No | 0.41 | 0.98 | Blue |
| 73 | SDP-4 | 35000 | 35 | No | 0.53 | 1.11 | Blue |
| 74 | SDP-4 | 30000 | 33 | No | 0.49 | 1.10 | Blue |
| 75 | SDP-4 | 25000 | 33 | No | 0.66 | 1.01 | Blue |
| 76 | SDP-4 | 20000 | 27 | No | 0.40 | 1.00 | Blue |

TABLE 11-continued

| Sample | SDP | Frequency (Hz) | Current (Ampere) | Blister | Optical Density Square 4 | Optical Density Square 6 | Colour |
|---|---|---|---|---|---|---|---|
| 77 | SDP-4 | 15000 | 29 | No | 0.53 | 1.04 | Mix |
| 78 | SDP-4 | 10000 | 31 | No | 0.62 | 1.00 | Mix |
| 79 | SDP-4 | 5000 | 33 | No | 0.65 | 0.94 | Mix |
| 80 | SDP-4 | 5000 | 25 | No | 0.4 | 0.58 | Black |
| 81 | SDP-4 | 3000 | 31 | No | 0.68 | 1.03 | Black |
| 82 | SDP-4 | 2000 | 29 | No | 0.59 | 0.95 | Black |
| 83 | SDP-4 | 1000 | 29 | No | 0.59 | 1.17 | Black |
| 84 | SDP-4 | 1000 | 27 | No | 0.47 | 0.84 | Black |
| 85 | SDP-4 | 500 | 29 | No | 0.61 | 1.20 | Black |
| 86 | SDP-4 | 500 | 27 | No | 0.52 | 0.81 | Black |
| 87 | SDP-5 | 50000 | 35 | Yes | 0.36 | 0.56 | Blue |
| 88 | SDP-5 | 45000 | 35 | Yes | 0.37 | 0.72 | Blue |
| 89 | SDP-5 | 40000 | 35 | Yes | 0.40 | 0.58 | Blue |
| 90 | SDP-5 | 35000 | 35 | Yes | 0.43 | 0.64 | Blue |
| 91 | SDP-5 | 30000 | 35 | Yes | 0.45 | 0.66 | Blue |
| 92 | SDP-5 | 25000 | 35 | Yes | 0.52 | 0.82 | Blue |
| 93 | SDP-5 | 20000 | 35 | Yes | 0.54 | 0.71 | Blue |
| 94 | SDP-5 | 15000 | 35 | Yes | 0.53 | 0.62 | Mix |
| 95 | SDP-5 | 10000 | 35 | Yes | 0.56 | 0.60 | Mix |
| 96 | SDP-5 | 5000 | 35 | Yes | 0.71 | 0.53 | Black |
| 97 | SDP-5 | 3000 | 33 | Yes | 0.70 | 1.10 | Black |
| 98 | SDP-5 | 2000 | 33 | Yes | 0.74 | 1.02 | Black |
| 99 | SDP-5 | 1000 | 33 | Yes | 0.97 | 0.88 | Black |
| 100 | SDP-5 | 500 | 35 | Yes | 1.30 | 0.98 | Black |

From Table 11, it should be clear that a blue colour was obtained in all cases for a frequency (=pulse repetition rate) above 15 kHz and a black colour was obtained in all cases for a frequency (=pulse repetition rate) below 5 kHz.

The invention claimed is:

1. A method of colour laser marking a security document precursor including at least:

a polymeric foil;

at least one colourless colour forming layer for generating a colour different from black containing at least an infrared absorber, a colour forming compound and a polymeric binder; and a laser markable polymeric support or a laser markable layer for generating a black colour through carbonization;

comprising the steps of:

laser marking the colourless colour forming layer with an infrared laser utilized in pulsed mode at a pulse repetition rate of at least 15 kHz to generate a colour different from black; and laser marking the laser markable polymeric support or the laser markable layer with the same infrared laser utilized in a pulsed mode at a pulse repetition rate of at most 5 kHz to generate a black colour.

2. The method according to claim 1, wherein the laser markable polymeric support is selected from polyethylene terephthalate, polycarbonate, polyvinyl chloride, polystyrene, polystyrene acrylonitrile butadiene, and copolymers thereof.

3. The method according to claim 1, wherein the laser markable layer includes:

i) a laser additive; and ii) a polymer selected from polystyrene, polycarbonate, and polystyrene acrylonitrile.

4. The method according to claim 1, wherein the polymeric foil is a transparent polymeric foil.

5. The method according to claim 4, wherein the polymeric foil is a biaxially stretched polyethylene terephthalate foil.

6. The method according to claim 1, wherein the laser is a solid state Q-switched laser.

7. The method according to claim 1, wherein the security document precursor contains at least three colourless colour forming layers each including a different infrared absorber and a different colour forming compound.

8. The method according to claim 1, wherein the infrared absorber is an infrared dye.

9. The method according to claim 1, wherein the colour forming compound is a colourless leuco dye.

10. The method according to claim 1, wherein the colourless colour forming layer for generating a colour different from black further including a hydrogen donor precursor.

11. The method according to claim 10 wherein the hydrogen donor precursor is 4,4'-Bis(tert-butoxycarbonyloxy) diphenyisulfone and the colour forming compound of the colourless colour forming layer is crystal violet lactone.

12. The method according to claim 11, wherein the obtained security document is selected from a passport, a personal identification card, and a product identification document.

13. The method according to claim 12, wherein the product identification document is attached to the packaging material of the product or to the product itself.

14. The method according to claim 12, wherein the security document contains electronic circuitry.

15. The method according to claim 14, wherein the electronic circuitry includes a RFID chip and/or a contact chip.

* * * * *